US011161343B2

(12) United States Patent
Tamamori et al.

(10) Patent No.: US 11,161,343 B2
(45) Date of Patent: Nov. 2, 2021

(54) LIQUID EJECTION HEAD AND MANUFACTURING METHOD THEREOF

(71) Applicant: CANON KABUSHIKI KAISHA, Tokyo (JP)

(72) Inventors: Kenji Tamamori, Ebina (JP); Masaki Ohsumi, Yokosuka (JP); Shingo Nagata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 16/725,405

(22) Filed: Dec. 23, 2019

(65) Prior Publication Data

US 2020/0198345 A1 Jun. 25, 2020

(30) Foreign Application Priority Data

Dec. 25, 2018 (JP) ..... JP2018-241165

(51) Int. Cl.

| | |
|---|---|
| ***B41J 2/14*** | (2006.01) |
| ***B41J 2/16*** | (2006.01) |
| ***B41J 2/165*** | (2006.01) |

(52) U.S. Cl.

CPC ..... *B41J 2/1433* (2013.01); *B41J 2/162* (2013.01); *B41J 2/1631* (2013.01); *B41J 2/16538* (2013.01); *B41J 2002/16502* (2013.01)

(58) Field of Classification Search

CPC ..... B41J 2/1433; B41J 2/162; B41J 2/1631; B41J 2/16538; B41J 2002/16502

See application file for complete search history.

(56) References Cited

U.S. PATENT DOCUMENTS

| | | | | |
|---|---|---|---|---|
| 2007/0120889 | A1* | 5/2007 | Kang | B41J 2/1631 347/45 |
| 2010/0097423 | A1* | 4/2010 | Inoue | B41J 2/14274 347/47 |
| 2019/0126622 | A1* | 5/2019 | Kuramoto | B41J 2/16538 |

FOREIGN PATENT DOCUMENTS

| | | |
|---|---|---|
| JP | 04-339659 A | 11/1992 |
| JP | 2018-199278 A | 12/2018 |

* cited by examiner

*Primary Examiner* — Anh T Vo
(74) *Attorney, Agent, or Firm* — Venable LLP

(57) ABSTRACT

A liquid ejection head includes an ejection orifice forming surface provided with an ejection orifice from which a liquid is ejected. The ejection orifice forming surface includes a first region in a vicinity of the ejection orifice, a second region that is further spaced apart from the ejection orifice than the first region and protrudes from the first region in a liquid ejection direction and a third region that connects the first region and the second region. When a contact angle of pure water in the first region is a first contact angle θ1 and a contact angle of pure water in the third region is a third contact angle θ3, θ1 is larger than θ3 by 10 degrees or more.

17 Claims, 5 Drawing Sheets

LIQUID EJECTION HEAD AND MANUFACTURING METHOD THEREOF

BACKGROUND OF THE INVENTION

Field of the Invention

The present invention relates to a liquid ejection head and a manufacturing method thereof.

Description of the Related Art

A liquid ejection head used in a liquid ejection apparatus of an ink jet recording apparatus includes an energy generating element and an ejection orifice. An ink supplied with energy for ejection from the energy generating element is ejected from the ejection orifice. Japanese Patent Application Laid-Open No. H04-339659 discloses a liquid ejection head in which a step portion protruding in an ink ejection direction is provided in a vicinity of the ejection orifice of a nozzle plate (ejection orifice forming member), and the vicinity of the ejection orifice and the step portion are covered with a water repellent treatment layer. The ejection orifice and the water repellent treatment layer therearound are able to be protected by providing the step. In addition, a liquid ejection head subjected to water repellency and hydrophilic treatments is described in Japanese Patent Application Laid-Open No. 2018-199278.

SUMMARY OF THE INVENTION

A liquid ejection head of the present invention includes an ejection orifice forming surface provided with an ejection orifice from which a liquid is ejected. The ejection orifice forming surface includes a first region in a vicinity of the ejection orifice, a second region that is further spaced apart from the ejection orifice than the first region and protrudes from the first region in a liquid ejection direction and a third region that connects the first region and the second region. $\theta 1$ is larger than $\theta 3$ by 10 degrees or more, when a contact angle of pure water in the first region is a first contact angle $\theta 1$ and a contact angle of pure water in the third region is a third contact angle $\theta 3$.

Further features of the present invention will become apparent from the following description of exemplary embodiments with reference to the attached drawings.

DESCRIPTION OF THE EMBODIMENTS

In the liquid ejection head disclosed in Japanese Patent Application Laid-Open No. H04-339659, the water repellent treatment layer provided on the vicinity of the ejection orifice and the step portion has a uniform water repellency, so that the ink uniformly adheres to the water repellent treatment layer. Therefore, the ink adhering to a vicinity of the ejection orifice due to mist is likely to be collected in the vicinity of the ejection orifice. An ink collected in the vicinity of the ejection orifice may adhere to the ejection orifice and cause ink ejection failure. An object of the present invention is to provide a liquid ejection head in which a liquid adhering to a vicinity of an ejection orifice is unlikely to collect in the vicinity of the ejection orifice.

Hereinafter, several embodiments of the liquid ejection head of the present invention will be described with reference to the drawings. The liquid ejection head of the present invention is able to be mounted not only on a printer but also on an industrial recording apparatus combined with a printer unit such as a copying machine, a facsimile machine, a word processor, and various processing apparatuses. Recording is able to be performed on various recording media such as paper, thread, fiber, leather, metal, plastic, glass, wood, and ceramic, by using an apparatus equipped with this liquid ejection head. The liquid ejection head of the present invention is also able to be applied as a head for ejecting a liquid for biochip manufacturing and electronic circuit printing. The liquid ejection head of the present invention is able to be particularly suitably used for an ink jet recording head that ejects a water-based ink. Therefore, the following embodiment is directed to a liquid ejection head that ejects an ink, and a liquid ejection head that ejects a liquid other than the ink is also able to be applied to the present invention. In the following description, a direction where a plurality of ejection orifice rows is arranged is X, a direction where each ejection orifice row extends is Y, and a direction orthogonal to a first region described later is Z. The direction X coincides with a wiping direction of a wiper blade W. The direction Z coincides with a thickness direction of a substrate 2. The direction X, the direction Y, and the direction Z are orthogonal to each other. In the direction X, the wiping direction of the wiper blade (from left to right in each drawing) is referred to as a wiping direction X1. In the direction Z, the direction from the substrate toward an ejection orifice forming member, that is, the direction orthogonal to the first region and further spaced apart from the substrate (from bottom to top in each drawing) is referred to as an ink ejection direction Z1.

First Embodiment

Figure 1A:
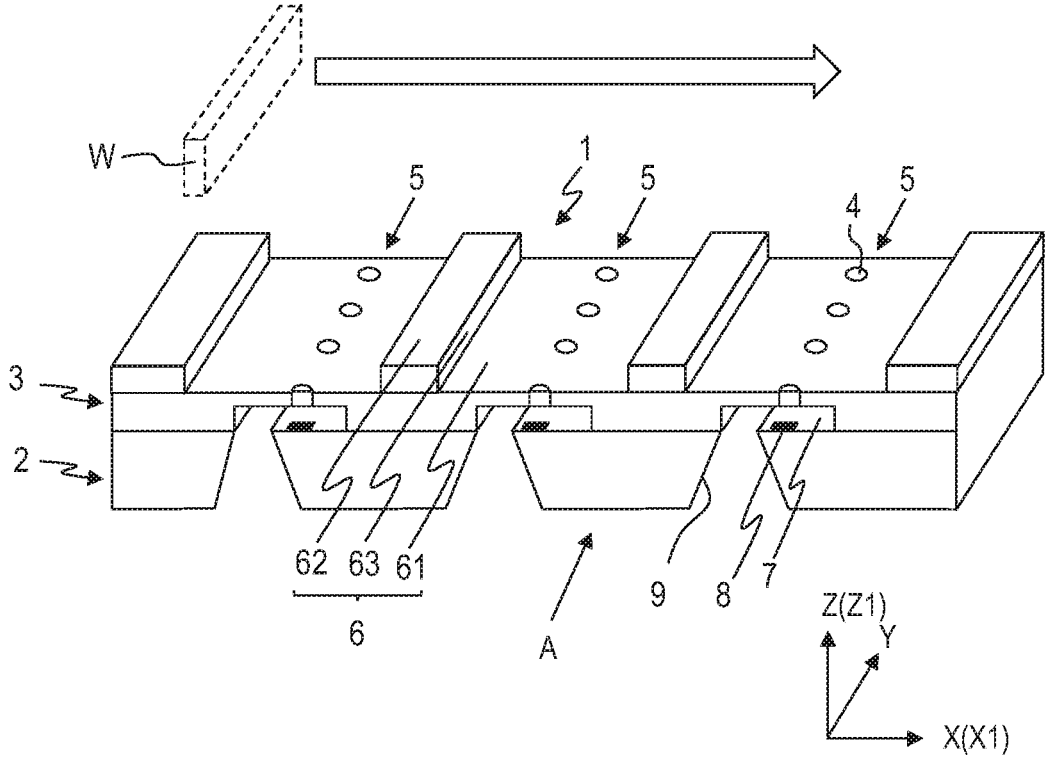
FIGS. 1A and 1B are diagrams illustrating a main part of a liquid ejection head according to a first embodiment of the present invention.
Figure 1B:
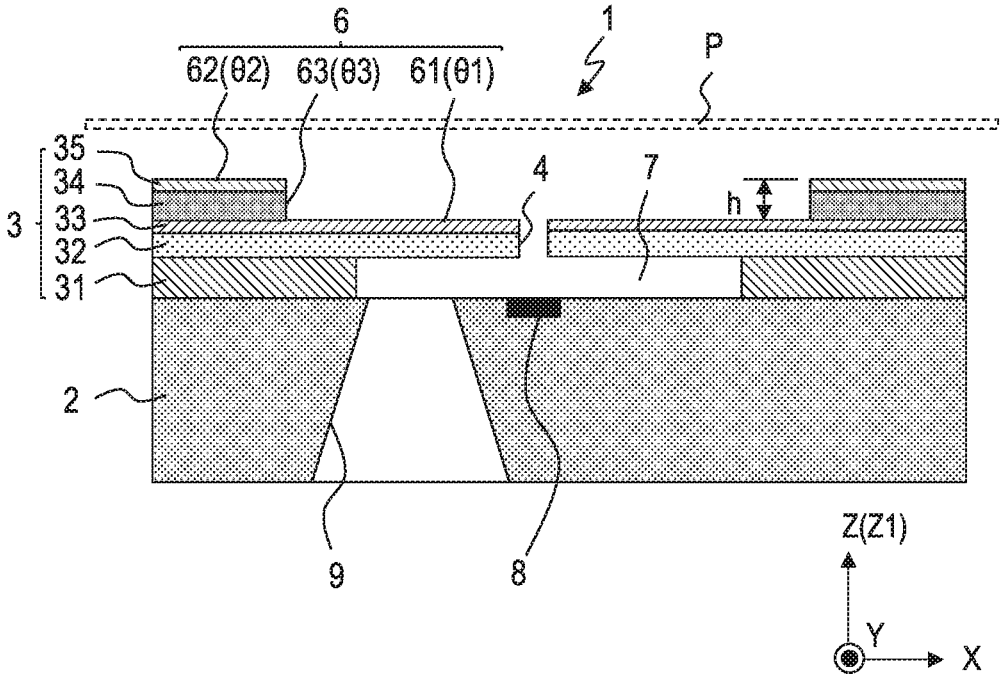

FIG. 1A is a perspective view illustrating a configuration of a main part of a liquid ejection head according to the first embodiment of the present invention, and FIG. 1B is a cross-sectional view of the liquid ejection head viewed from a direction A of FIG. 1A. A liquid ejection head 1 includes an ejection orifice forming member 3 in which a plurality of ejection orifices 4 is formed, and a substrate 2 that supports the ejection orifice forming member 3. The ejection orifice forming member 3 is formed on a surface of the substrate 2 facing a recording medium P. The ejection orifice forming member 3 is made of resin, and the substrate 2 is made of single crystal silicon. The plurality of ejection orifices 4 is divided into a plurality of ejection orifice rows 5 according to a color of ink to be ejected. Each ejection orifice row 5 includes the plurality of ejection orifices 4. In the present embodiment, three ejection orifice rows 5 are provided, and the number of ejection orifice rows 5 is not limited, and is able to be certain number of 1 or more.

A pressure chamber 7 communicating with the ejection orifice 4 is formed inside the ejection orifice forming member 3. An energy generating element 8 that generates energy for ejecting ink is formed at a position facing the ejection orifice 4 and the pressure chamber 7 of the substrate 2. The energy generating element 8 is an electro-thermal conversion element (heater), and a piezoelectric element is also able to be used. A protective film (not illustrated) for protecting the energy generating element 8 may be formed on the energy generating element 8. Electrical wiring (not illustrated) for supplying power and signals for driving to the energy generating element 8 is formed inside the substrate 2. Furthermore, a supply path 9 that penetrates the substrate 2 in the thickness direction and communicates with the pressure chamber 7 is formed in the substrate 2. An ink-resistant protective film (not illustrated) may be formed on a surface of the substrate 2 that contacts the ink. The ink supplied from a rear surface of the substrate 2 is supplied to the pressure chamber 7 through the supply path 9, is given energy by the energy generating element 8, and is ejected as droplets from the ejection orifice 4. The structure of the pressure chamber 7 and the supply path 9 of the present embodiment is an example, and this invention is not limited to these structures.

The ejection orifice forming member 3 includes a pressure chamber forming layer 31, a first base layer 32, a first water repellent layer 33, a second base layer 34 and a second water repellent layer 35. These layers are sequentially formed on the substrate 2 in this order. The surface facing the recording medium P is an ejection orifice forming surface 6 provided with the ejection orifice 4 ejecting the ink. The pressure chamber forming layer 31 forms a side wall of the pressure chamber 7, and the first base layer 32 and the first water repellent layer 33 form a top plate of the pressure chamber 7. The first water repellent layer 33 is laminated on the surface of the first base layer 32 and includes a first region 61 described later. The second base layer 34 is laminated on the surface of the first water repellent layer 33 and is provided in a portion adjacent to the first region 61 of the first water repellent layer 33. The second water repellent layer 35 is laminated on the surface of the second base layer 34 and includes a second region 62 described later. The first water repellent layer 33 is also provided between the first base layer 32 and the second base layer 34. As a result, deformation of the ejection orifice forming member 3 due to stress or swelling of the first water repellent layer 33 is able to be reduced. A plurality of second base layers 34 and second water repellent layers 35 is provided, and are provided alternately with the ejection orifice rows 5 along an arrangement direction X of the ejection orifice rows 5. In addition, the plurality of second base layers 34 and the plurality of second water repellent layers 35 extend in the direction Y parallel to the ejection orifice rows 5 with each of the ejection orifice rows 5 interposed therebetween.

The pressure chamber forming layer 31 is formed of, for example, a negative photosensitive resin. As the negative photosensitive resin, for example, an epoxy resin, an acrylic resin, and a urethane resin are able to be suitably used. Examples of the epoxy resin include a bisphenol A type, a cresol novolac type, a cyclic epoxy resin, an acrylic resin such as polymethyl methacrylate and a urethane resin such as polyurethane. Examples of the solvent for the negative photosensitive resin include one or more solvents selected from the group consisting of propylene glycol methyl ether acetate (PGMEA), cyclohexane, methyl ethyl ketone and xylene. An additive may be added to the solvent as needed. The thickness of the pressure chamber forming layer 31 corresponds to a flow path height of the pressure chamber 7, and can be selected from a range of 5 to 25 μm, for example. An adhesion improving film (not illustrated) may be formed on the substrate 2 in advance in order to improve the adhesion between the substrate 2 and the pressure chamber forming layer 31.

The first base layer 32 and the second base layer 34 are formed of a resin material such as a photosensitive epoxy composition. The first base layer 32 and the second base layer 34 is also able to be formed of one of an inorganic material and a metal material. The difference between these linear expansion coefficients can be small in order to reduce thermal deformation due to the difference in linear expansion coefficient between the first base layer 32 and the second base layer 34. The thickness of the first base layer 32 substantially corresponds to the flow path length of the ejection orifice 4 in the Z direction, and can be selected from a range of 3 to 7 μm, for example. The thickness of the second base layer 34 substantially corresponds to the height difference h in the ink ejection direction Z1 between the first region 61 and the second region 62, and can be 10 μm or more, for example. The first water repellent layer 33 and the second water repellent layer 35 are formed of, for example, an epoxy resin composition containing a fluorine-based water repellent component. The film thicknesses of the first water repellent layer 33 and the second water repellent layer 35 can be selected from a range of 0.1 μm to 1 μm, for example.

The ejection orifice forming surface 6 includes the first region 61, the second region 62 and a third region 63. The first region 61 is a region in the vicinity of the ejection orifice 4, that is, a region surrounding the ejection orifice 4. The second region 62 is a region that is further spaced apart from the ejection orifice 4 in the X direction than the first region 61, and protrudes from the first region 61 in the ink ejection direction Z1. The third region 63 is a step region that connects the first region 61 and the second region 62. As described above, the liquid ejection head 1 is provided with the plurality of second base layers 34 and the plurality of second water repellent layers 35. Therefore, a set in which the second region 62, the third region 63 and the first region 61 are arranged in this order along the X direction is repeatedly arranged in the X direction on the ejection orifice forming surface 6. The first region 61 is formed by the first water repellent layer 33 and the second region 62 is formed by the second water repellent layer 35. The third region 63 is formed by the end surfaces of the second base layer 34 and the second water repellent layer 35 that face the first region 61. The third region 63 is formed substantially perpendicular to the first region 61 and the second region 62. Although the range and size of the second region 62 are not particularly limited, the circuit portion can be covered with the second region 62, in a case where a circuit portion (not illustrated) is disposed in the vicinity of the ejection orifice 4, for example. As a result, when the liquid ejection head 1 is mounted or used, the circuit portion is able to be protected from foreign matters by the second base layer 34 and the second water repellent layer 35, and the reliability of the circuit portion is able to be improved.

The first region 61, the second region 62 and the third region 63 each have a unique contact angle. In the following description, a contact angle in the first region 61 is referred to as a first contact angle θ1, a contact angle in the second region 62 is referred to as a second contact angle θ2 and a contact angle in the third region 63 is referred to as a third contact angle θ3. The first to third contact angles θ1 to θ3 are defined as contact angles with respect to pure water, and may be defined with respect to the ink used.

The first contact angle θ1 can be larger than the third contact angle θ3 (θ1>θ3), more suitably by 10 degrees or more, and still more suitably by 20 degrees or more. As a result, the ink adhering to the vicinity of the ejection orifice 4 due to mist is likely to move to the third region 63, and the ejection orifice 4 is unlikely to be clogged by the ink. Similarly, the second contact angle θ2 is can be larger than the third contact angle θ3 (θ2>θ3), more suitably by 10 degrees or more, and still more suitably by 20 degrees or more. Since the second region 62 protrudes toward the recording medium P with respect to the first region 61 (distance from the recording medium P is smaller than those of the other regions 61 and 63), the ink adhering to the second region 62 is scattered and is likely to adhere to the recording medium P, and printing defects due to ink adhesion are likely to occur. When the second contact angle θ2 is small, the ink is likely to adhere to the second region 62. Therefore, the ink droplet thickness is likely to increase in the second region 62, and the ink is likely to adhere to the recording medium P. By setting θ3>θ2, it is difficult for ink to adhere to the second region 62, and the ink is able to be prevented from adhering to the recording medium P.

The ink adhering to the first region 61 due to mist may adversely affect ink ejection. As described above, the ink adhered to the second region 62 may also adversely affect the print quality. Therefore, the ink adhering to the ejection orifice forming surface 6 due to mist is wiped off by the wiper blade W. The wiper blade W is normally provided in a liquid ejection apparatus on which the liquid ejection head 1 is mounted. The wiper blade W comes in contact with the second region 62, the third region 63 and the first region 61 in this order to wipe off the ejection orifice forming surface 6 while moving in the wiping direction X1. Since θ1>θ3 and θ2>θ3, the unwiped ink moves from the first region 61 and the second region 62 to the third region 63, and is likely to be held in the third region 63. Accordingly, even when the ejection orifice forming surface 6 is wiped off with the wiper blade W, the unwiped ink in the first region 61 and the second region 62 is reduced, so that printing defects are able to be suppressed.

Furthermore, a relationship of θ1≥θ2>θ3 can be established among the first contact angle θ1, the second contact angle θ2 and the third contact angle θ3. In a case where the ink adheres across the first region 61, the second region 62 and the third region 63, the ink adhering to the first region 61 and the second region 62 is collected in the third region 63, and is likely to be held in the third region 63. As a result, the ink adhering to the ejection orifice forming surface 6 is able to be divided in the X direction. In the case of θ1=θ2, the ink in the first region 61 is more likely to be held in the third region 63 than the ink in the second region 62, and it is possible to effectively suppress the clogging of the ejection orifice 4 with the ink. In the case of θ1=θ2, it is likely to collect both the ink of the first region 61 and the ink of the second region 62 in the third region 63, and it is possible to efficiently suppress both the clogging of the ejection orifice 4 with ink and the printing defects due to ink adhesion. The relationship between the first contact angle θ1 and the second contact angle θ2 is able to be determined in consideration of these effects, and the difference between the first contact angle θ1 and the second contact angle θ2 cannot be too large. Accordingly, the difference between the first contact angle θ1 and the second contact angle θ2 can be 0 degree or more to 10 degrees or less. In the case of θ1<θ2, the ink in the first region 61 is relatively unlikely to be held in the third region 63, and as long as the relationship of θ1>θ3 is established, it is possible to satisfy θ1<θ2. The first region 61, the second region 62 and the third region 63 cannot be hydrophilic, and can be water repellent, or closer to water repellent than hydrophilic. The first contact angle θ1 and the second contact angle θ2 can be in the range of 80° 110°, for example, and the third contact angle θ3 can be in the range of 50° to 75°, for example.

The first contact angle θ1 and the second contact angle θ2 are formed by the first water repellent layer 33 and the second water repellent layer 35, respectively. The specific configurations of the first water repellent layer 33 and the second water repellent layer 35 are not limited at all. For example, the first water repellent layer 33 and the second water repellent layer 35 may be formed of different materials from each other, or different treatments may be applied to the same material, in order that the first contact angle θ1 and the second contact angle θ2 satisfy the above-described favorable numerical range and satisfy the condition of θ1>θ2. The same material is able to be used for the first water repellent layer 33 and the second water repellent layer 35, in order that the first contact angle θ1 and the second contact angle θ2 satisfy the above-described favorable numerical range and satisfy the condition of θ1=θ2. The specific configuration of the third region 63 is not limited as long as the favorable condition of the third contact angle θ3 described above is satisfied. For example, a water repellent layer that satisfies the favorable condition of the third contact angle θ3 may be formed in the third region 63, or the water repellent layer may not be formed, in a case where the surface of the third region 63 satisfies the favorable condition of the third contact angle θ3. In a case where the water repellent layer is formed in the third region 63, for example, an epoxy resin composition containing a fluorine-based water repellent component is able to be used as the water repellent layer, similarly to the first water repellent layer 33 and the second water repellent layer 35.

The height difference h between the first region 61 and the second region 62 in the ink ejection direction Z1, that is, the height of the third region 63 in the ink ejection direction Z1 can be at least 10 μm or more. The height difference h is equal to a difference between the Z-direction interval between the substrate 2 and the first region 61 and a Z-direction interval between the substrate 2 and the second region 62, and is substantially equal to the thickness of the first base layer 32. As a result, when the ink adhering to the ejection orifice forming surface 6 is wiped off with the wiper blade W, it is possible to ensure a surface area where the third region 63 holds the unwiped ink.

Second Embodiment

Figure 2:
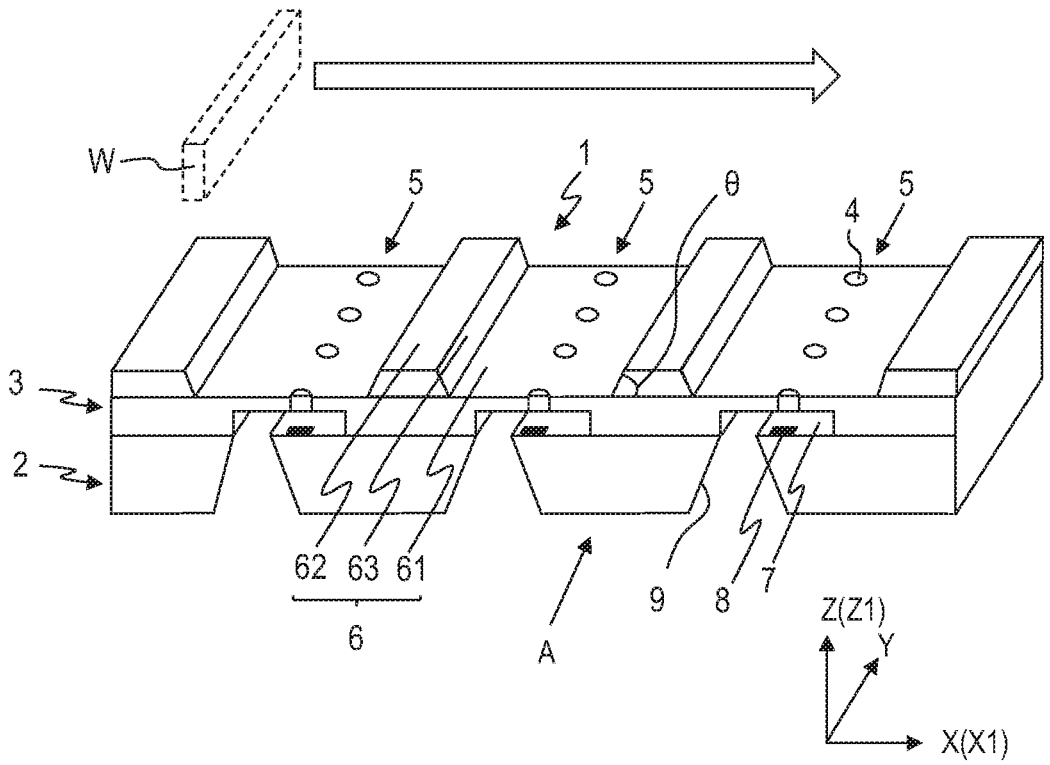
FIG. 2 is a diagram illustrating a main part of a liquid ejection head according to a second embodiment of the present invention.

FIG. 2 is a perspective view illustrating a configuration of a main part of a liquid ejection head 1 according to a second embodiment of the present invention. Here, differences from the first embodiment will be mainly described. In the present embodiment, the third region 63 is inclined with respect to the first region 61. In other words, the first region 61 and the third region 63 form an obtuse angle. The inclination angle θ can be 30 degrees or more to less than 90 degrees, that is, the obtuse angle formed by the first region 61 and the third region 63 is more than 90 degrees to 150 degrees or less. The third region 63 has a substantially planar shape, and may have a curved surface shape. In this case, the inclination angle θ is able to be obtained as an average inclination angle. Since the third region 63 is inclined with respect to the first region 61, the surface area of the third region 63 increases, compared with the case where the third region 63 is perpendicular to the first region 61 as in the first embodiment. Therefore, when the ejection orifice forming surface 6 is wiped with the wiper blade W, the ink wiped in the first region 61 is likely to be held in the third region 63. In addition, since the wiper blade W is able to be moved more smoothly along the third region 63 connecting the first region 61 and the second region 62, the ink adhering to the ejection orifice forming surface 6 is likely to be removed. For these reasons, since the unwiped ink when the ink adhering to the ejection orifice forming surface 6 is wiped off with the wiper blade W is reduced, it is possible to suppress printing defects.

Third Embodiment

Figure 3:
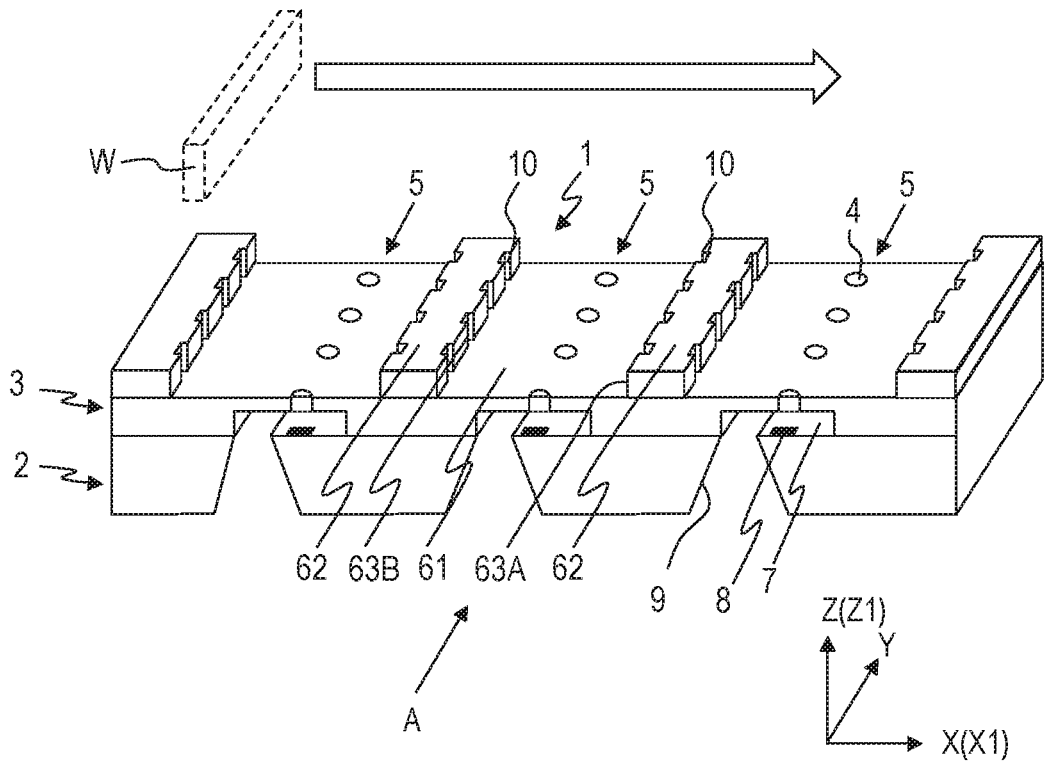
FIG. 3 is a diagram illustrating a main part of a liquid ejection head according to a third embodiment of the present invention.

FIG. 3 is a perspective view illustrating a configuration of a main part of a liquid ejection head 1 according to a third embodiment of the present invention. Here, differences from the first embodiment will be mainly described. In the present embodiment, with respect to the wiping direction X1 of the wiper blade W, the third regions 63 on both sides of the first region 61 are distinguished as follows. First, with respect to the wiping direction X1 of the wiper blade W, the third region 63 connected to the first region 61 on the downstream side of the first region 61 is referred to as a third region 63A on the downstream side. With respect to the wiping direction X1 of the wiper blade W, the third region 63 connected to the first region 61 on the upstream side of the first region 61 is referred to as a third region 63B on the upstream side (also called the other third region 63B). The third contact angle θ3 of the third region 63A on the downstream side and the third region 63B on the upstream side may be the same or different from each other. The third contact angle θ3 of any of the regions 63A and 63B satisfies the above-described relationship regarding the first to third contact angles θ1 to θ3. The third region 63A on the downstream side and the third region 63B on the upstream side have an uneven shape 10. The uneven shape 10 has suitably the uneven shape viewed from the ink ejection direction Z1, and is formed as a groove 10 (or rib) extending from the second region 62 to the first region 61 in the ink ejection direction Z1, for example. A plurality of grooves 10 is provided, and the width of the grooves 10 can be 20 μm or more, for example. Since the surface area of the third region 63A on the downstream side and the third region 63B on the upstream side is increased by the uneven shape 10, when wiping with the wiper blade W, the ink wiped off in the first region 61 is likely to be held in the third regions 63A and 63B. As a result, since the unwiped ink when wiping the ink adhering to the ejection orifice forming surface 6 with the wiper blade W decreases, printing defects are able to be suppressed. The third region 63B on the upstream side is less required to hold the ink than the third region 63A on the downstream side, and by providing the uneven shape 10, the ink holding function of the third region 63A on the downstream side is able to be supplemented. Although illustration is omitted, the third region 63A on the downstream side and the third region 63B on the upstream side may be inclined with respect to the first region 61 as in the second embodiment. The uneven shape 10 can be the above-described groove 10 in consideration of a manufacturing method described later, and may be a groove extending in the Y direction, or a recessed or projection portion.

Fourth Embodiment

Figure 4:
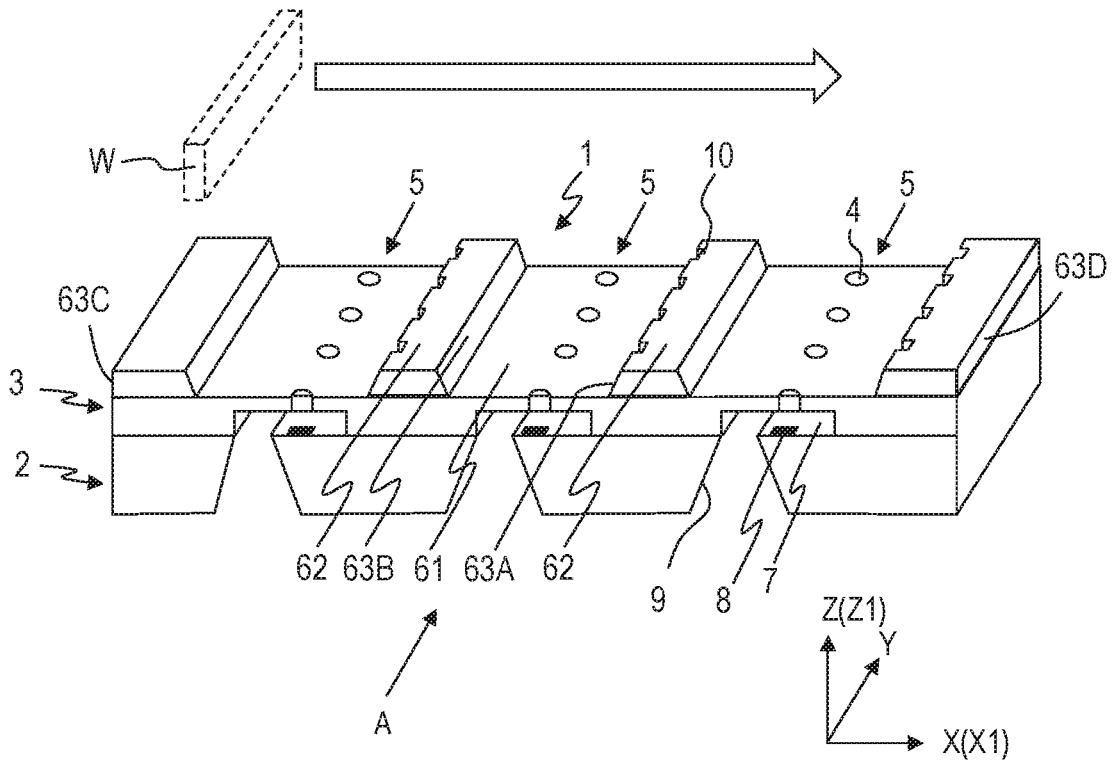
FIG. 4 is a diagram illustrating a main part of a liquid ejection head according to a fourth embodiment of the present invention.

FIG. 4 is a perspective view illustrating a configuration of a main part of a liquid ejection head 1 according to a fourth embodiment of the present invention. Here, differences from the first embodiment will be mainly described. In the present embodiment, similarly to the third embodiment, the third regions 63 on both sides of the first region 61 with respect to the wiping direction X1 of the wiper blade W are distinguished. In the present embodiment, the third region 63A on the downstream side and the third region 63B on the upstream side have different shapes. Specifically, the third region 63A on the downstream side is inclined with respect to the first region 61 and has the uneven shape 10. The third region 63B on the upstream side is inclined with respect to the first region 61, and does not have the uneven shape 10. The reason why the third region 63B on the upstream side does not have the uneven shape 10 is because the necessity of holding the ink wiped from the first region 61 is small. On the other hand, since the third region 63A on the downstream side and the third region 63B on the upstream side are inclined with respect to the first region 61, the wiper blade W is able to be moved smoothly. As a result, the ink adhering to the ejection orifice forming surface 6 is likely to be removed. The third region 63A on the downstream side has a larger surface area than that of the third region 63B on the upstream side, and when wiping the ejection orifice forming surface 6 with the wiper blade W, the ink wiped from the first region 61 is likely to be collected. Therefore, the ink wiped off in the first region 61 is unlikely to move the downstream side.

An aspect in which the shapes of the third region 63A on the downstream side and the third region 63B on the upstream side are different from each other is not limited to the present embodiment. For example, in the above embodiment, the third region 63B on the upstream side is perpendicular to the first region 61 and may not have the uneven shape 10. Alternatively, the third region 63A on the downstream side may not have the uneven shape 10, and the third region 63B on the upstream side may have the uneven shape 10. The third region 63C located on the most upstream and the third region 63D located on the most downstream with respect to the wiping direction X1 of the wiper blade W are perpendicular to the first region 61 and do not have the uneven shape 10. This is because these regions do not need to hold the ink and the need to smoothly move the wiper blade W is small. In addition, an increase in the dimension of the liquid ejection head 1 in the X direction is able to be suppressed by doing in this manner.

Method of Manufacturing Liquid Ejection Head 1

Figure 5A:
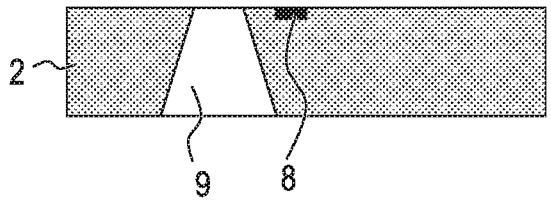
FIGS. 5A, 5B, 5C, 5D, 5E, 5F and 5G are step diagrams illustrating a method of manufacturing the liquid ejection head illustrated in FIGS. 1A and 1B.

Next, an example of a method of manufacturing the liquid ejection head 1 of the present invention will be described including examples. FIGS. 5A to 5G comprise a schematic step diagram illustrating a procedure of a method of manufacturing the liquid ejection head 1 according to the first embodiment of the present invention, and FIGS. 5A to 5G are cross-sectional views viewed from a direction A of FIG. 1A. First, as illustrated in FIG. 5A, the supply path 9 is formed on the substrate 2 on which the energy generating element 8 and electrical wiring (not illustrated) are formed. The supply path 9 is able to be formed by dry etching such as reactive ion etching, wet etching using TMAH or KOH, laser ablation, or sandblasting. In the example, the supply path 9 is formed on the substrate 2 made of single crystal silicon and having a thickness of 625 μm by using the Bosch process based on a reactive ion etching (RIE) method.

Figure 5B:
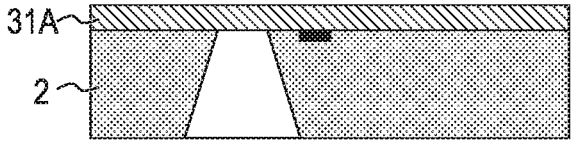

Next, as illustrated in FIG. 5B, a resin layer 31A, which is the pressure chamber forming layer 31, is formed on the upper surface of the substrate 2. The resin layer 31A is able to be formed by a laminating method, for example. Specifically, a dry film is formed on a support body (not illustrated), the dry film is transferred (bonded) to the substrate 2 while applying temperature and pressure, for example, and thereafter the support body is removed. The dry film is able to be formed, for example, by applying a resin to the support body by a spin coating method or a slit coating method and performing a baking treatment. The transfer can be performed using, for example, a roll laminating apparatus under vacuum in consideration of the absence of bubbles between the substrate 2 and the dry film and the discharge of bubbles. Examples of the support body include a film, a glass substrate, and a silicon substrate. In consideration of the ease of detaching of the support body, a film is favorable, and the surface of the support body may be subjected to a mold release treatment in order to easily detach the support body. Examples of the film include a polyethylene terephthalate (PET) film, a polyimide film, and a hydrocarbon film. In the example, a PET film having a thickness of 100 μm was used as a support body, and an epoxy resin (including N-695) was applied to the support body by a spin coating method. Thereafter, baking treatment is performed to form a dry film having a thickness of 15 μm. In order to improve the detachability, the PET film was subjected to a mold release treatment. Next, a dry film was laminated on the substrate 2 under vacuum at a stage temperature of 75° C., a roller temperature of 60° C., a roller pressure of 0.2 MPa, and a roller speed of 5 mm/s, using a roll laminating apparatus. Thereafter, the support body was detached at room temperature. The sensitivity of the dry film was adjusted so that the portion of the dry film, which is the pressure chamber 7, was able to be selectively exposure patterning.

Figure 5C:
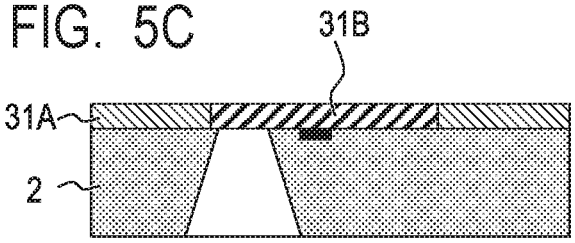

Next, as illustrated in FIG. 5C, processing for removing a portion 31B (portion, which is the pressure chamber 7) of the resin layer 31A is performed. The processing method is able to be appropriately selected in consideration of consistency with the material and process of the resin layer 31A. In a case where the portion 31B of the resin layer 31A is removed by etching, an etching mask (not illustrated) that protects a remaining portion is formed, the portion 31B of the resin layer 31A is removed, and thereafter the etching mask is removed. In a case where the resin layer 31A is a photosensitive resin, the portion 31B of the resin layer 31A is able to be removed by photolithography. In a case where the resin layer 31A is a negative photosensitive resin, since an irradiated portion of the resin layer 31A remains and an unirradiated portion is removed by development, the portion to be removed is masked so that light is not irradiated. In a case where the negative photosensitive resin is a chemical amplification type, post exposure baking (PEB) can be performed after photolithography exposure and before development. Development may be performed at this stage, or may be performed at once as a development step for another film to be laminated next. By using photolithography, high-precision alignment using alignment marks (not illustrated) formed on the mask and the substrate 2 is able to be performed, and the positional relationship between the pressure chamber 7 and the energy generating element 8 is able to be formed with high accuracy. In the example, a latent image was formed on the resin layer 31A so that an unexposed portion 31B is the pressure chamber 7 by irradiating light having a wavelength of 365 nm through a photo-mask with an exposure amount of 5000 J/m$^2$ and performing PEB at 50° C. for 5 minutes.

Figure 5D:
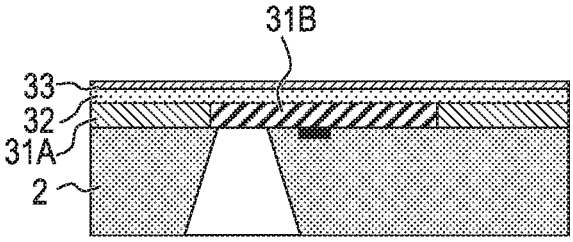
Figure 5E:
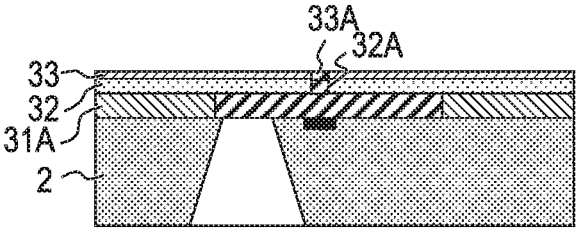

Next, as illustrated in FIG. 5D, the first base layer 32 is laminated on the resin layer 31A, which is the pressure chamber forming layer 31, and a first water repellent layer 33 that forms the first region 61 is further laminated on the first base layer 32. The first base layer 32 is able to be formed by the same method as the resin layer 31A illustrated in FIG. 5B, for example, a method using a dry film, and PEB is able to be similarly performed. A film forming method of the first water repellent layer 33 is able to be selected according to the material. In a case where the first water repellent layer 33 is made of a photosensitive resin composition, for example, a spin coating method or a slit coating method is able to be used. In the example, the first base layer 32 is laminated on the resin layer 31A under vacuum at a stage temperature and a roller temperature of 50° C., a roller pressure of 0.2 MPa, and a roller speed of 5 mm/s, using a roll laminating apparatus. Thereafter, the support body (not illustrated) was detached at room temperature. A sensitivity difference was provided between the first base layer 32 and the resin layer 31A so that the unexposed portion 31B, which is the pressure chamber 7 of the resin layer 31A, was not exposed in a next exposure step. Thereafter, the first water repellent layer 33 was formed to a thickness of 0.6 μm on the first base layer 32 by using a slit coating method, and baked at 50° C. for 5 minutes after the film formation. Next, as illustrated in FIG. 5E, processing for removing a portion 32A of the first base layer 32 and a portion 33A of the first water repellent layer 33 is performed. For this processing, the same method as described in FIG. 5C is able to be used. In the example, light having an exposure wavelength of 365 nm was irradiated through a photo-mask (not illustrated) with an exposure amount of 1000 J/m$^2$. Next, a latent image was formed on the first base layer 32 and the first water repellent layer 33 so that the unexposed portions 32A and 33A were the ejection orifices 4, by performing PEB for 4 minutes at 90° C.

Figure 5F:
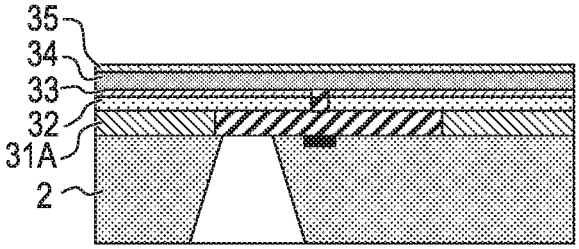

Next, as illustrated in FIG. 5F, the second base layer 34 and the second water repellent layer 35 that forms the second region 62 are formed on the first water repellent layer 33. The second base layer 34 and the second water repellent layer 35 are able to be formed using the same method as described in FIG. 5D. In a case where the second base layer 34 is, for example, a photosensitive resin, when the second base layer 34 is applied on the first water repellent layer 33 by a spin application method, the second base layer 34 may be repelled by the first water repellent layer 33 and may not be applied with a uniform film thickness. In this case, the second base layer 34 is able to be formed on the first water repellent layer 33 by forming the second base layer 34 with a dry film and reducing the amount of residual solvent. Dry film formation is able to be performed by the same method as described in FIG. 5D. In the example, the second base layer 34 formed into a dry film was laminated on the first water repellent layer 33 under vacuum at a stage temperature and a roller temperature of 50° C., a roller pressure of 0.2 MPa, and a roller speed of 5 mm/s by using a roll laminating apparatus on the first water repellent layer 33. The second base layer 34 uses the same negative epoxy resin as the dry film of the pressure chamber forming layer 31 and has a thickness of 10 μm. Thereafter, the support body (not illustrated) was detached at room temperature. Furthermore, the second water repellent layer 35 was formed on the second base layer 34 with a film thickness of 0.6 μm by using a slit coating method, and baked at 50° C. for 5 minutes after the film formation.

Figure 5G:
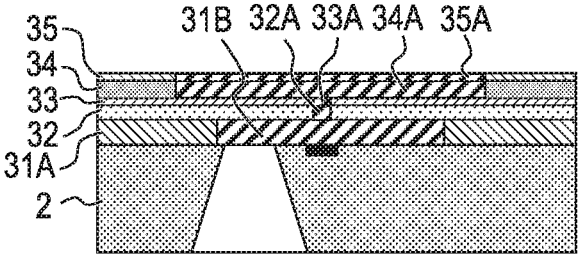

Next, as illustrated in FIG. 5G, processing for removing the portion 34A of the second base layer 34 and the portion 35A of the second water repellent layer 35 is performed. For this processing, the same method as described in FIG. 5C is able to be used. In a case where the second base layer 34 is, for example, a photosensitive resin composition and the second water repellent layer 35 is, for example, a photosensitive resin composition containing a fluorine-based water repellent component, both of which are chemical application type, PEB can be performed after exposure and before development. By setting the temperature of the PEB to be the softening point of the second base layer 34 or lower, for example, diffusion of the water repellent component of the first water repellent layer 33 to the second base layer 34 is able to be suppressed. As a result, the water repellency of the first water repellent layer 33 is able to be maintained when a portion of the second base layer 34 is removed. In the example, light having an exposure wavelength of 365 nm was irradiated through a photo-mask (not illustrated) with an exposure amount of 1200 J/m$^2$. Next, a latent image was formed so that the unexposed portions of the second base layer and the second water repellent layer 35 were the first region 61, by performing PEB for 4 minutes at 60° C. of the softening point of the second base layer 34 or lower. The third region 63 having a slope shape in the second embodiment is able to be created as follows. In a case where portions of the second base layer 34 and the second water repellent layer 35 are removed by etching, an etching mask (not illustrated) may be formed in a tapered shape, and the etching selectivity with respect to the etching mask may be lowered than 1, for example. In the case where the second base layer 34 is a photosensitive resin, the third region 63 is able to be formed in a slope shape by adjusting the photolithography conditions and baking conditions of the second base layer 34. In order to form the uneven shape 10 in the third region 63 as in the third embodiment, a corresponding portion of an etching mask or a photolithography photomask may be formed in the uneven shape.

Next, the resin layer 31A, the first base layer 32, the first water repellent layer 33, the second base layer 34, and the second water repellent layer 35 are developed, and the pressure chamber 7, the ejection orifice 4, and the first region 61 are formed. In the case where the resin layer 31A, the first base layer 32, the first water repellent layer 33, the second base layer 34, and the second water repellent layer 35 are negative photosensitive resin compositions, as described above, unexposed portions are able to be removed at once by developing with a developer. Examples of the developer include PGMEA, tetrahydrofuran, cyclohexanone, methyl ethyl ketone, and xylene. When the unexposed portion is removed by development, as illustrated in FIG. 1B, the unexposed portion 31B of the resin layer 31A is the pressure chamber 7, and the unexposed portion 32A and 33A of the first base layer 32 and the first water repellent layer 33 are the ejection orifice 4. In addition, by removing the unexposed portions 34A and 35A of the second base layer 34 and the second water repellent layer 35, the first water repellent layer 33 is exposed, and the first region 61 and the third region 63 are formed. Thereafter, a third water repellent layer (not illustrated) that satisfies $\theta1 \geq \theta2 > \theta3$ may be formed in the third region 63. In a case where the resin layer 31A, the first base layer 32, the first water repellent layer 33, the second base layer 34, and the second water repellent layer 35 are negative photosensitive resin compositions, heat treatment may be performed in order to promote curing, for example. In the example, unexposed portions were removed at once by developing with PGMEA. Next, heat treatment was performed in a nitrogen atmosphere at 200° C. for 1 hour to cure the ejection orifice forming member 3. Thereafter, the substrate 2 is cut with a dicing saw to form chips, and electrical wiring for driving the energy generating element 8 and a chip tank member for supplying ink are attached to each chip, so that the liquid ejection head 1 is completed.

Example

The liquid ejection head 1 was created by the above manufacturing method. The first contact angle θ1, the second contact angle θ2 and the third contact angle θ3 were 95°, 90°, and 65°, respectively, and the relationship $\theta1 \geq \theta2 > \theta3$ was satisfied. The first water repellent layer 33 and the second water repellent layer 35 are formed in the first region 61 and the second region 62, respectively, and the water repellent layer is not formed in the third region 63. For the first water repellent layer 33 and the second water repellent layer 35, an epoxy resin composition containing a fluorine-based water repellent component was used. The height difference h between the first region 61 and the third region 63 was 10 μm. The ink that flowed from the chip tank for supplying ink into the supply path 9 was ejected from the ejection orifice 4 through the pressure chamber 7. It was confirmed that the ink adhering to the ejection orifice forming surface 6 by mist moves from the first region 61 and the second region 62 to the third region 63 and is held in the third region 63. When the ink adhering to the ejection orifice forming surface 6 is wiped off with the wiper blade W, it was confirmed that the unwiped ink was moved from the first region 61 and the second region 62 to the third region 63 and held in the third region 63. As a result of printing using the liquid ejection head 1, good printing results were obtained. This is considered because the inflow of the ink adhering to the ejection orifice forming surface 6 to the ejection orifice 4 and the adhesion to the recording medium P were suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-241165, filed Dec. 25, 2018, which is hereby incorporated by reference herein in its entirety.

What is claimed is:

1. A liquid ejection head comprising:

an ejection orifice forming surface provided with an ejection orifice from which a liquid is ejected, wherein the ejection orifice forming surface includes:

a first region in a vicinity of the ejection orifice, a second region that is further spaced apart from the ejection orifice than the first region and protrudes from the first region in a liquid ejection direction, and a third region that connects the first region and the second region, and θ1 is larger than θ3 by 10 degrees or more, when a contact angle of pure water in the first region is a first contact angle θ1 and a contact angle of pure water in the third region is a third contact angle θ3.

2. The liquid ejection head according to claim 1, wherein $\theta1 \geq \theta2 > \theta3$, when a contact angle of pure water in the second region is a second contact angle θ2.

3. The liquid ejection head according to claim 2, wherein the second contact angle θ2 is larger than the third contact angle θ3 by 10 degrees or more.

4. The liquid ejection head according to claim 2, wherein a difference between the first contact angle θ1 and the second contact angle θ2 is 0 degree or more to 10 degrees or less.

5. The liquid ejection head according to claim 1, wherein the third region is inclined with respect to the first region.

6. The liquid ejection head according to claim 1, wherein the third region has an uneven shape.

7. The liquid ejection head according to claim 6, wherein the third region has a groove extending from the second region to the first region.

8. The liquid ejection head according to claim 5, wherein the third region is connected to the first region on a downstream side of the first region with respect to a wiping direction of a wiper blade.

9. The liquid ejection head according to claim 8, further comprising:

another third region connected to the first region on an upstream side of the first region with respect to the wiping direction of the wiper blade, wherein a contact angle of pure water in the other third region is less than the first contact angle θ1, and the third region and the other third region have different shapes from each other.

10. The liquid ejection head according to claim 9, wherein the other third region has an uneven shape.

11. The liquid ejection head according to claim 10, wherein the other third region has a groove extending from the second region to the first region.

12. The liquid ejection head according to claim 9, wherein the other third region has a surface area smaller than that of the third region.

13. The liquid ejection head according to claim 1, wherein a difference in height between the first region and the second region in the liquid ejection direction is at least 10 μm or more.

14. The liquid ejection head according to claim 1, further comprising:

a first base layer;

a first water repellent layer laminated on the first base layer and including the first region;

a second base layer laminated on a portion adjacent to the first region of the first water repellent layer; and a second water repellent layer laminated on the second base layer and including the second region.

15. A method of manufacturing a liquid ejection head comprising:

sequentially forming a resin layer, a first base layer, a first water repellent layer, a second base layer and a second water repellent layer on a substrate in which a flow path is formed;

forming a pressure chamber in communication with the flow path by removing a portion of the resin layer;

forming an ejection orifice in communication with the pressure chamber by removing a portion of the first base layer and a portion of the first water repellent layer; and exposing the first water repellent layer in a vicinity of the ejection orifice by removing a portion of the second base layer and a portion of the second water repellent layer, wherein the exposed first water repellent layer includes a first region, the second water repellent layer includes a second region, end surfaces of the second base layer and the second water repellent layer facing the first region include a third region, and there is a relationship of $\theta 1 > \theta 3$, when a contact angle of pure water in the first region is a first contact angle θ1, and a contact angle of pure water in the third region is a third contact angle θ3.

16. The method of manufacturing a liquid ejection head according to claim 15, wherein the first and second base layers are formed of a dry film, and a portion of the first and second base layers and a portion of the first and second water repellent layers are removed by exposure, post exposure baking and development.

17. The method of manufacturing a liquid ejection head according to claim 16, wherein the post exposure baking of the second base layer is performed at a temperature equal to or lower than a softening point of the second base layer.

* * * * *